US008581526B1

(12) United States Patent
Hofler

(10) Patent No.: US 8,581,526 B1
(45) Date of Patent: Nov. 12, 2013

(54) UNBALANCED FIELD RF ELECTRON GUN

(75) Inventor: Alicia Hofler, Newport News, VA (US)

(73) Assignee: Jefferson Science Associates, LLC, Newport News, VA (US)

( * ) Notice: Subject to any disclaimer, the term of this patent is extended or adjusted under 35 U.S.C. 154(b) by 0 days.

(21) Appl. No.: 12/807,136

(22) Filed: Aug. 28, 2010

(51) Int. Cl.
*H05H 7/00* (2006.01)

(52) U.S. Cl.
USPC ..... 315/506; 315/111.61; 315/111.81

(58) Field of Classification Search
USPC ..... 315/501, 506, 111.61, 111.81
See application file for complete search history.

(56) References Cited

U.S. PATENT DOCUMENTS 4,400,650 A * 8/1983 Giebeler, Jr. ..... 315/5.41
4,563,615 A * 1/1986 Mourier ..... 315/39.3
6,670,620 B1 * 12/2003 Okunuki ..... 250/492.2
7,601,042 B2 * 10/2009 Srinivasan-Rao et al. ..... 445/23

* cited by examiner

*Primary Examiner* — Douglas W Owens
*Assistant Examiner* — Jianzi Chen

(57) ABSTRACT

A design for an RF electron gun having a gun cavity utilizing an unbalanced electric field arrangement. Essentially, the electric field in the first (partial) cell has higher field strength than the electric field in the second (full) cell of the electron gun. The accompanying method discloses the use of the unbalanced field arrangement in the operation of an RF electron gun in order to accelerate an electron beam.

5 Claims, 6 Drawing Sheets

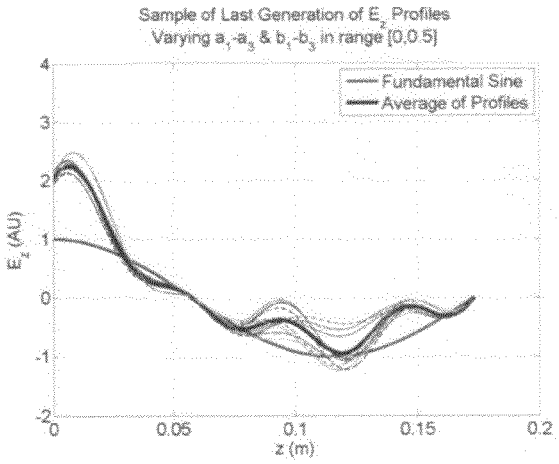
Figure 1: Varying the first three Fourier coefficients
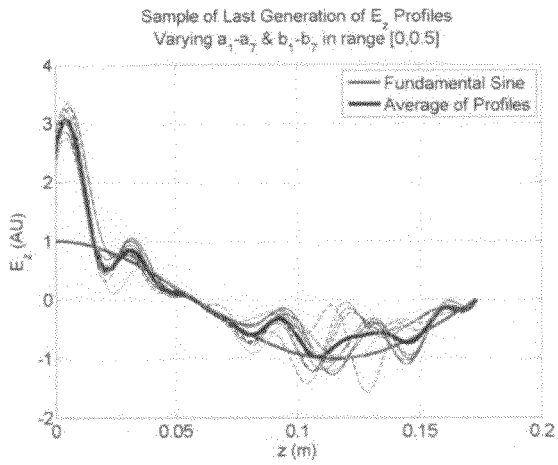
Figure 2: Varying the first seven Fourier coefficients

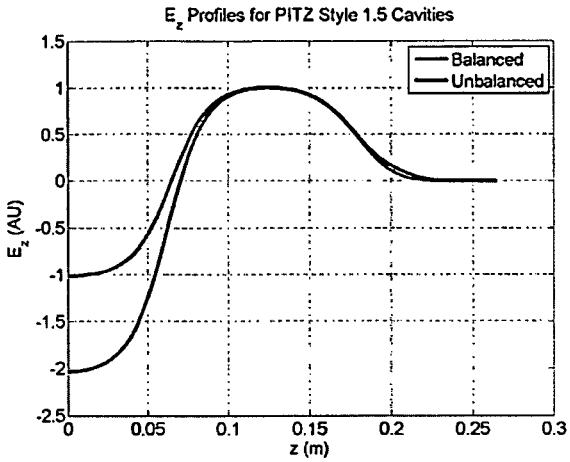
Figure 5: Normalized $E_z$ profiles for the two geometries
| Element | Dimension | Change |
|---|---|---|
| Half Cell | radius | -37.4 μm |
| Iris | radius | +0.5 mm |
| Full Cell | radius | +162.6 μm |
Figure 6: Changes relative to prior art RF electron gun

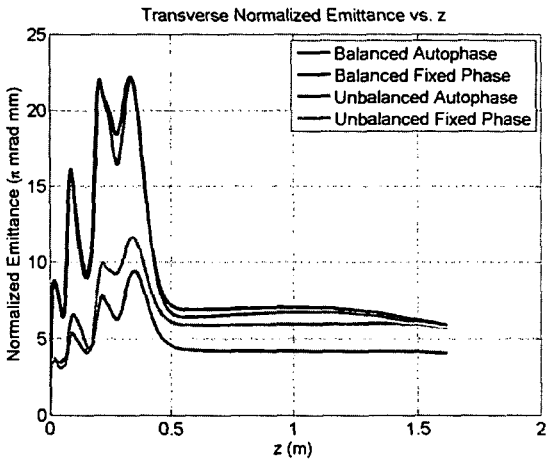
Figure 7: Transverse emittance along beam line

UNBALANCED FIELD RF ELECTRON GUN

The United States of America may have certain rights to this invention under Management and Operating Contract No. DE-AC05-84ER 40150 from the Department of Energy.

FIELD OF THE INVENTION

The present invention relates to the design and operation of a radio frequency electron gun and the acceleration of electron beams in such devices, and, more particularly, a more effective RF electron gun cavity design and mode of operation which provides superior electron beam quality.

BACKGROUND OF THE INVENTION

Electron guns are employed in a variety of applications in the world today. The components of the electron gun and the method of operation depend upon the particular application. Radio frequency guns are a type of electron gun used as particle sources in certain applications. An RF electron gun uses a time varying electric field to accelerate electrons emitted from a cathode. In a common scenario, an RF electron gun can be employed as a particle source for a free electron laser apparatus designed to generate x-ray radiation. Such x-ray light sources have aggressive electron beam quality requirements, e.g. maximum brightness, lowest transverse emittance beam, and in some cases, sufficient charge in the electron bunches to achieve self-amplified spontaneous emission.

The Linac Coherent Light Source (LCLS) at the SLAC National Accelerator Laboratory and the Deutsches Elektronen-Synchrotron (DESY) Free Electron Laser in Hamburg (FLASH) are two test facilities which operate x-ray radiation generating free electron lasers (FEL). Each FEL, in turn, includes an RF electron gun as the initial particle source. One RF electron gun currently employed at FLASH developed at the Photo Injector Test Facility at the DESY's Zeuthen location (PITZ) is a $Cs_2Te$ photocathode device accelerated by a 1.5 cell copper cavity operating in the it mode at 1.3 GHz (hereinafter referred to as the PITZ device). Another example of a state-of-the art electron gun currently in use can be found at the LCLS facility. The LCLS electron gun (hereinafter LCLS device) is an RF electron gun comprised of 1.6 cells. Both devices use an electric field to accelerate photo-emitted electrons.

In both cases the RF electron gun design is such that the cathode is disposed in, or immediately adjacent to, the first cell. In these designs, the first cell is always the partial cell. Moreover, the primary design goal for such RF electron guns has historically been to maintain overall electric field flatness in order to achieve a balanced electric field in both the first (partial) cell and second (full) cell. In such cases, the peak on-axis electric field is the same magnitude in both cells.

Alternatively, an unbalanced field is sometimes used in such electron guns, with the peak electric field being of greater magnitude in the second, full cell. Finally, it is also known in the art to marginally increase the field strength in the first cell relative to the second cell in order to reduce the space charge effect. In such cases, the field strength disparity is marginal, at best, and would not vary by more than ten or fifteen percent.

When generating x-ray radiation under such conditions, it is always preferable to have an electron beam of the highest possible quality with the lowest transverse emittance and, consequently, the smallest electron beam spot size. It is therefore an object of this invention to provide an apparatus and method which improves electron beam quality and other beam characteristics in an RF electron gun.

OBJECT OF THE INVENTION

It is an object of the invention to provide a design for an RF electron gun and a method of use, providing for the use of an unbalanced electric field in order to accelerate the electron beam, thereby improving electron beam quality and improving beam charge transmission.

SUMMARY OF THE INVENTION

The present invention describes a design for an RF electron gun having a gun cavity composed of at least one full cell and at least one partial cell. In such a device, the peak electric field of the gun cavity is located in the first (partial) cell of the device. In a preferred embodiment, the amplitude of the electric field in the first (partial) cell is essentially twice that of the amplitude of the electric field in the second (full) cell. The accompanying method discloses the use of the unbalanced field arrangement in the operation of an RF electron gun.

DESCRIPTION OF THE DRAWINGS

FIG. 1 shows $E_z$ profiles while varying the first three pairs of Fourier coefficients of an idealized field description.

FIG. 2 shows $E_z$ profiles while varying the first seven pairs of Fourier coefficients of an idealized field description.

FIG. 5 shows normalized $E_z$ profiles for both the balanced and the unbalanced cavity geometries.

FIG. 6 shows the structural/dimensional changes necessary to modify a prior art RF electron gun.

FIG. 7 illustrates transverse emittance along the electron beam line under various operational condition.

DETAILED DESCRIPTION

Figure 3:
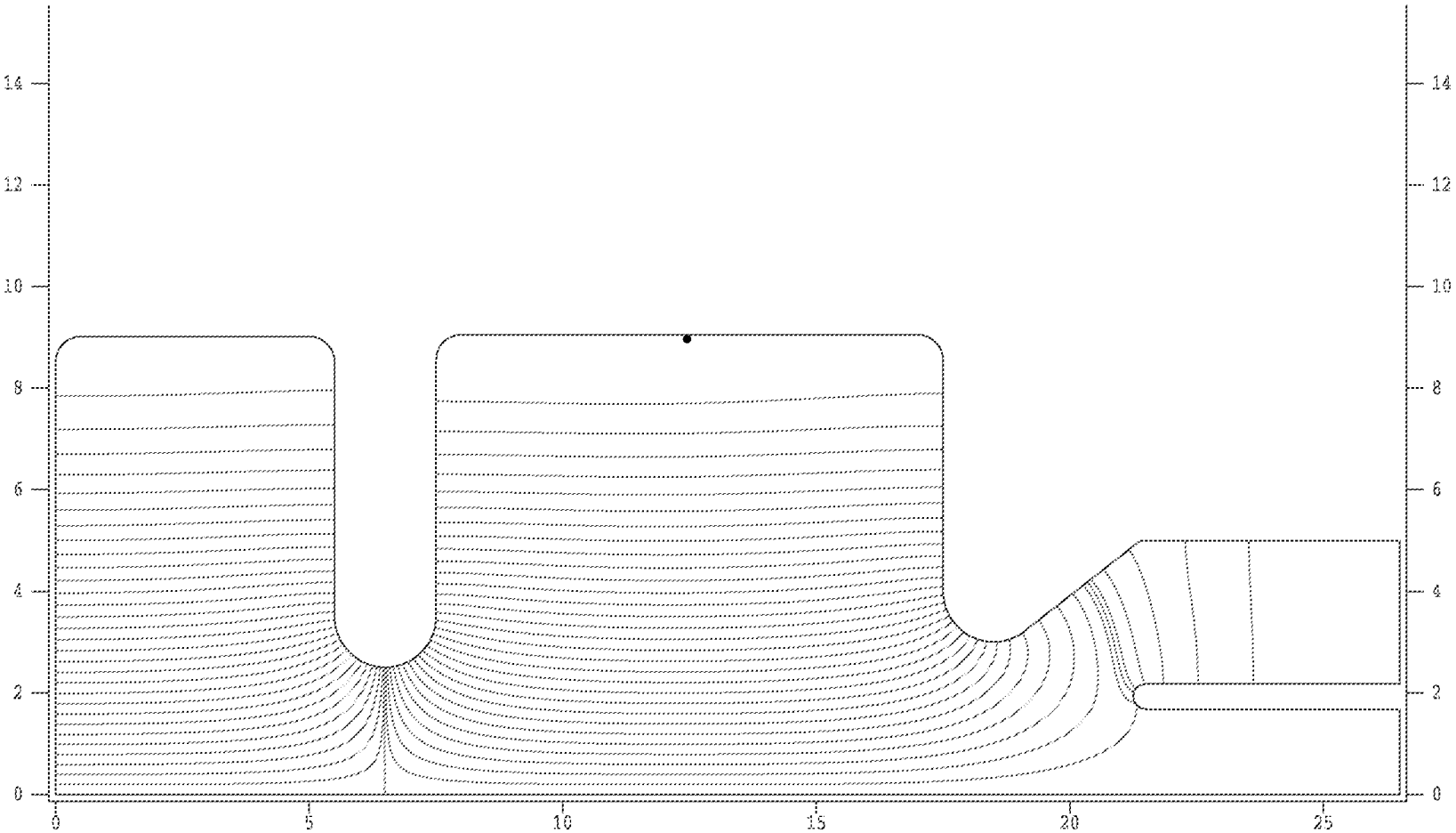
FIG. 3 illustrates standard balanced field cavity geometry for an electron gun assembly with 1.5 cells as currently employed in the art.

The method and device disclosed herein uses an RF electron gun cavity unbalanced field arrangement as an alternative to traditional electric field ratios currently employed in the art.

In a standard RF electron gun arrangement in use today, the gun cavity is composed of a full cell and a partial cell. An electron-emitting photocathode ejects electrons into the first cell, which is always the partial cell. The electrons then travel to the full cell and ultimately leave the electron gun device. Time-varying electric fields are used to accelerate the electrons within the gun cavity from cell to cell and then to emission from the gun cavity. In a balanced field arrangement, the peak on-axis electric field in both cells is approximately equal.

The device and method disclosed herein relate to an RF electron gun 100 with a gun cavity having two or more cells. In a preferred embodiment, the gun cavity is composed of two cells, a first partial cell 105 and a second full cell 110. In this embodiment the first partial cell is approximately half of the size of the second full cell. However, it will be recognized that the partial cell can be larger or smaller, so long as it is smaller than the second full cell, and the same theories set forth herein would apply. A cathode 115 is disposed adjacent to a portion of the gun cavity defined by the first cell and at least one solenoid 120 is partially surrounding at least a portion of the partial cell and the full cell.

This embodiment of the RF electron gun includes an electric field for acceleration of the beam within the gun cavity, as described above. However, the electric field is not generally balanced between the first and second cell. The electric field of the first (partial) cell has an amplitude that is at least twice the amplitude of the second (full) cell.

The on-axis portion of an accelerating or π mode electric field resembles a sine wave where the zero crossings of the sine wave occur between the cells in the cavity. Using a model free from boundary condition constraints, the on-axis profile for an accelerating or π mode electric field can be approximated with $$E_z(z) = \sin(2\pi fz)\left[1 + \sum_{n=1}^{15} a_n \cos\left(2\pi n \frac{z}{L_{cavity}}\right) + \sum_{n=1}^{15} b_n \sin\left(2\pi n \frac{z}{L_{cavity}}\right)\right]$$

where $E_z(z)$ is the spatially dependent amplitude of the on-axis field, sin 2πfz characterizes an idealized π mode electric field, f is the resonant frequency of the π mode, $L_{cavity}$ is the length of the cavity, and the balance in [•] is a unitless truncated Fourier series used to modify the shape of the π mode. By varying the coefficients $a_n$ and $b_n$, one can change the characteristics of the field profile and use this model in beam dynamics simulations. Varying these coefficients in response to changes in beam quality in an injector simulation, field profiles as found in FIGS. 1 and 2 arise for a 1.5 cell RF electron gun. In these figures, the fundamental sine curve represents the idealized balanced π mode and the zero crossing occurs between the first (half) cell and the full cell. The other curves represent variations on the idealized π mode. In the profiles in both FIGS. 1 and 2, the amplitude in the first cell is generally twice the amplitude in the full cell. As more coefficients are allowed to vary, the peak amplitude moves closer to the cathode wall.

Figure 4:
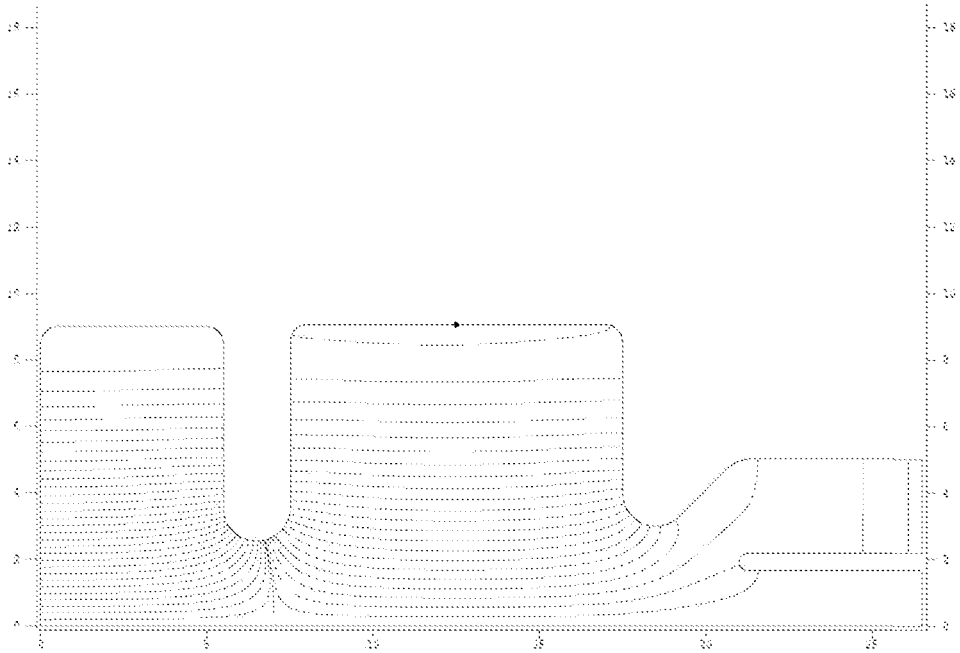
FIG. 4 demonstrates unbalanced field cavity geometry as it would appear in a 1.5 cell device as currently employed in the art.
Figure 8:
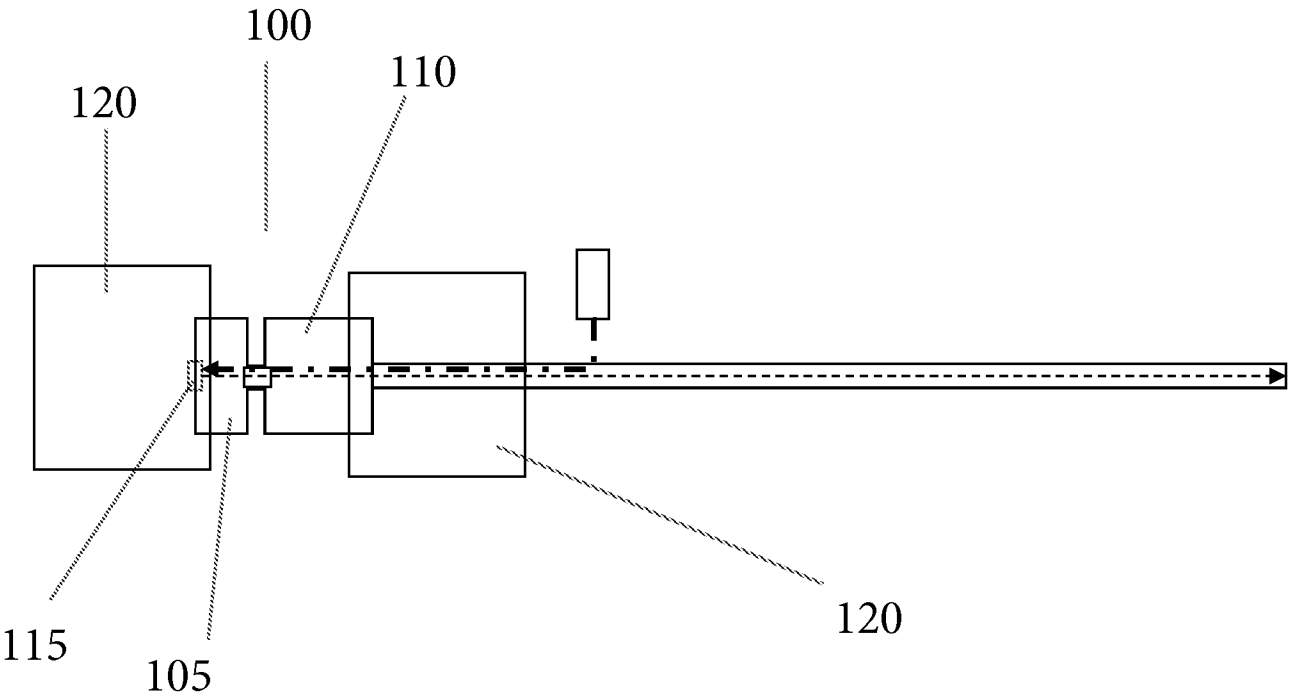
FIG. 8 is a side view of an RF gun cavity in an RF gun system.

FIG. 3 illustrates the balanced field geometry of the currently employed PITZ device. FIG. 4 shows a similarly structured device, i.e. having 1.5 cells, operating with an unbalanced field, as disclosed herein. As is readily seen in FIG. 5, the field in the first cell is twice as high as that of the second cell in the unbalanced arrangement.

In a traditional balanced field arrangement, the accelerating fields within the cells of the gun cavity are either equal or the maximum accelerating field is in the second (full) cell. In the instant device, the maximum accelerating field is in the first (partial) cell and, therefore, in the cathode region.

Referring now to FIG. 5, it will be seen that the on-axis field profiles of both the balanced and unbalanced arrangements are substantially similar with the only deviation occurring generally adjacent to the cathode.

The geometry of the electron gun cell cavity directly affects the electric field characteristics of the cell. Therefore, the strength of the electric field in each respective cell can be regulated or tuned through changes in the geometrical configuration of each cell cavity. FIG. 6 shows the changes that would be required in order to modify the PITZ device so that it would operate using the unbalanced field model disclosed herein.

The use of the unbalanced field arrangement provides substantial benefits over the conventional balanced field design. The unbalanced field design can produce an electron beam possessing electron bunches with improved beam qualities and significantly improved charge transmission (as compared to an electron beam generated pursuant to a traditional balanced arrangement).

The benefits of the unbalanced field arrangement can be seen through a simulated comparison of the operation of the PITZ electron gun, first using a balanced electric field, as traditionally encountered, and then subsequently using an unbalanced field arrangement, as taught herein. In this comparison, the balanced arrangement had a peak field of 40 MV/m, whereas the unbalanced arrangement had a peak field of 80 MV/m, essentially double the peak field value of the balanced arrangement.

As can be seen in FIG. 7, the final emittance for the fixed phase unbalanced scenario is comparable to both the fixed phase and autophased balanced electric field results. However, when the electron gun with the unbalanced arrangement is operated for maximum energy gain (autophased) there is an overall improvement in emittance. As also seen in FIG. 7, the transverse emittance along the beam line is of the lowest value when the electron gun is operating in unbalanced autophase mode. The improved emittance may be attributed to the increased RF focusing from the higher field gradient in the first half cell. In addition, the charge transmission is significantly better in the unbalanced arrangement. Referring back now to FIGS. 1 and 2, it can be seen that in cases where it is a goal to minimize transverse emittance and beam size, the use of an unbalanced arrangement with the maximum accelerating field in the first half cell yields superior beam quality.

While the invention has been described in reference to certain preferred embodiments, it will be readily apparent to one of ordinary skill in the art that certain modifications or variations may be made to the system without departing from the scope of invention claimed below and described in the foregoing specification.

What is claimed is:

1. A radio frequency electron gun comprising:

a partial cell defining a first cavity;

a full cell adjacent to and in communication with said partial cell defining a second cavity;

at least one solenoid partially surrounding at least a portion of said partial cell and said full cell;

an electric field being maintained in said partial cell and said full cell such that the amplitude of the electric field in the partial cell is at least twenty percent greater than the amplitude of the electric field in the full cell; and a cathode disposed adjacent to said first cavity and oriented in such a direction as to operate to deposit charged particles into said partial cell.

2. The electron gun of claim 1 wherein said partial cell is one-half the size of said full cell.

3. The electron gun of claim 1 wherein the amplitude of the electric field in the partial cell is generally twice the amplitude of the electric field in the full cell.

4. A method of accelerating an electron beam in a radio frequency electron gun comprising:

providing an electron gun cavity having a partial first cell and a full second cell;

providing an electron beam along the longitudinal axis of said gun cavity;

generating an electron accelerating electric field in said gun cavity; and maintaining said electric field in said cavity such that the field strength of said electric field in the partial first cell is at least of twenty percent greater strength than the field strength in the full second cell.

5. A method of operating a radio frequency electron gun comprising:

originating an electric field in the gun cavity of said electron gun;

maintaining said electric field at such levels that the highest peak electric field is located in the first cell of said gun cavity; and accelerating electrons with said electric field.

* * * * *